United States Patent [19]

Berge et al.

[11] 4,378,209

[45] Mar. 29, 1983

[54] GAS LEVITATOR HAVING FIXED LEVITATION NODE FOR CONTAINERLESS PROCESSING

[75] Inventors: Leroy H. Berge, Athens, Ala.; William A. Oran, Reston, Va.; John M. Theiss, Fayetteville, Tenn.

[73] Assignee: The United States of America as represented by the Administrator of the National Aeronautics and Space Administration, Washington, D.C.

[21] Appl. No.: 297,486

[22] Filed: Aug. 28, 1981

[51] Int. Cl.[3] ..... F27B 15/00; F24J 3/00

[52] U.S. Cl. ..... 432/58; 34/57 A; 156/DIG. 62; 432/227

[58] Field of Search ..... 432/11, 14, 58, 227; 34/57 A; 156/DIG. 62; 219/7.5

[56] References Cited

U.S. PATENT DOCUMENTS

| | | | |
|---|---|---|---|
| 246,690 | 9/1881 | Robinson | 432/14 |
| 2,538,833 | 1/1951 | De Rycke | 34/57 A |
| 2,619,776 | 12/1952 | Potters | 432/13 |
| 2,749,109 | 6/1956 | Maud | 432/11 |
| 3,241,520 | 3/1966 | Wurster et al. | 34/57 A |
| 4,284,403 | 8/1981 | Rey | 432/1 |

*Primary Examiner*—John J. Camby

*Attorney, Agent, or Firm*—Joseph H. Beumer; John R. Manning; Leon D. Wofford, Jr.

[57] ABSTRACT

A method and apparatus is disclosed for levitating a specimen of material in a containerless environment at a stable nodal position independent of gravity which includes providing an elongated levitation tube 10 having contoured interior in the form of convergent section 12, constriction 15 and divergent section 14 wherein the levitation node 16 is created. Gas flow control means 30, 54 controls flow to prevent separation of flow from the interior walls in the region of specimen 18. Apparatus 64, 66, provides for levitating and heating the specimen 18 simultaneously by combustion of a suitable gas mixture combined with an inert gas 74.

3 Claims, 6 Drawing Figures

GAS LEVITATOR HAVING FIXED LEVITATION NODE FOR CONTAINERLESS PROCESSING

ORIGIN OF THE INVENTION

The invention described herein was made by employees of the United States Government and may be manufactured and used by or for the Government for governmental purposes without the payment of any royalties thereon or therefor.

BACKGROUND OF THE INVENTION

This disclosure describes apparatus for performing containerless material processing of both conducting and nonconducting materials on earth and in the low gravity of space. The apparatus maintains the material at a fixed levitation node, in a stable manner, without physical or electromagnetic support, in a gas filled volume. This disclosure describes the method of levitating materials by aerodynamic forces created by gas flowing through an enclosed volume. The enclosed volume contains a convergent-divergent section. The duct cross-section is either circular or rectangular. Spheres and right circular cylinders can be levitated by a conduit having circular cross-section while cylinders can be levitated in a stable manner by a conduit having a rectangular cross-section.

Heretofore, a column of gas has been utilized to support objects during scientific research for example, the growth of a drop of water supported by the upward flow of a cloud has been studied in a vertical tapered tube. The water drop was held stationary in the tube by varying the upward velocity of the air flow until the drag forces on the sphere equalled the drop weight. Airplane spin characteristics have been studied using free falling scale models in a vertical air column. Very small uranium spheres have been levitated in argon/-flourine gas, above 1400K, using a vertical jet comprised of a central jet tube surrounded by multiple equally spaced jets of the same diameter All jets exhausted into a funnel shaped nozzle and an electromagnetic field was used to maintain stability.

These examples of single, vertical jets, become unstable when the jet axis is tilted so that the object center of gravity is no longer colinear with the jet axis.

Other attempts to provide containerless processing of materials using air jets has included several individual jets placed at equal spherical angles impinging on a central material object.

On earth, metal samples for metallurgical anaylsis are melted without a container while suspended and heated by a high frequency electric field. This technique is being extended to space processing because it is not gravity dependent.

Apparatus for shaping and enhancing acoustical levitation forces is illustrated in U.S. Pat. No. 4,218,921. High power acoustic fields provide levitation forces adequate to position small spheres of material in space. Interest in acoustic levitation has been stimulated by potential space applications but does not have a history of wide usage in earth laboratories.

Acoustic levitation in liquids can be accomplished on earth by establishing standing waves in a column of liquid. A droplet of another liquid, immiscible in the column liquid will position itself in a stable manner near a pressure node, when an acoustic transducer establishes a high intensity sound field. However, levitation of fluids in an immiscible fluid is not a technique useful in containerless processing.

The prior art for earth applications, utilizing a single jet, are gravity dependent for positioning and are not applicable to low gravity operation.

This disclosure describes a gas levitator which will support the material as the levitator axis is rotated from vertical to horizontal, to inverted, to vertical. This levitator can be used on earth at any angle of inclination with respect to an earth reference and in space.

In addition, none of the prior levitation devices have demonstrated the capability of containerlessly processing non-conducting material at high temperature (i.e., $\geqq 800°$ C.). The materials which have been successfully processed were conductors only. Electromagnetic coil assemblies have been required to provide stable levitation of the melt.

Accordingly, an important object of the present invention is to provide an apparatus for positioning a material specimen in a containerless environment for processing on earth and in low gravity environments.

Another important object of the present invention is to provide a simple apparatus for levitating a specimen by means of a gas which will operate in any orientation and is not gravity dependent.

Still another important object of the present invention is to provide a gas levitator device which will operate in any orientation and provides a stable positioning of the specimen.

Another important object of the present invention is to provide a gas levitator device which will operate over a broad temperature range.

Another important object of the invention is to provide apparatus for levitating a specimen in a gas which will operate for conductors and non-conductors as well.

SUMMARY OF THE INVENTION

The above objectives are accomplished according to the present invention by means of an elongated gas levitator tube having a convergent/divergent section wherein the material is levitated at a node in the divergent section. The tube may be oriented in any direction and the specimen remains stable in its levitated position. Numerous arrangements for developing a sufficient gas flow through the tube to levitate the specimen are illustrated.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein:

FIG. 1A is a cross-section taken along line 1A—1A of FIG. 1.

FIG. 2A is a cross-section taken along lines 2A—2A of FIG. 2;

DESCRIPTION OF A PREFERRED EMBODIMENT

Figure 1:
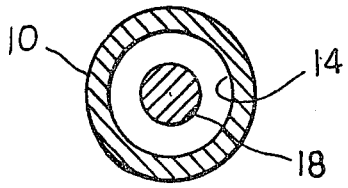
FIG. 1 is a perspective view with parts cut away illustrating a gas levitator device constructed according to the present invention.
Figure 1:
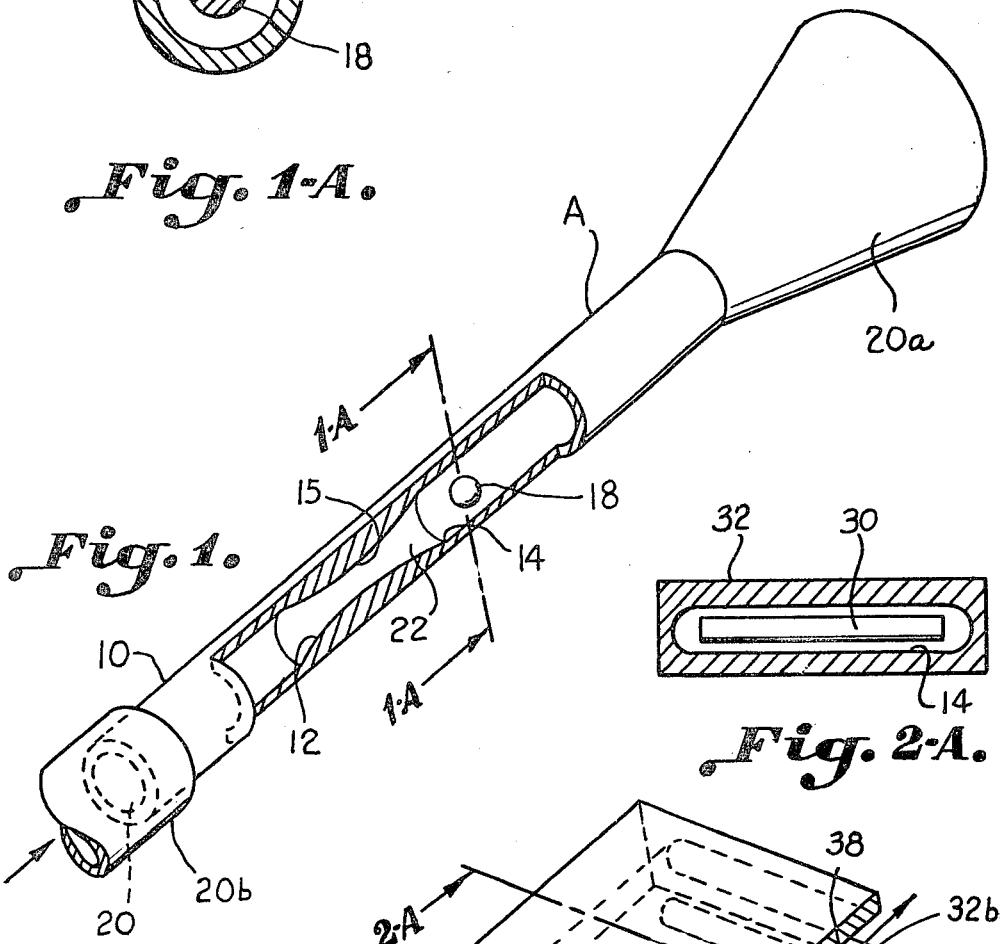

The disclosure relates to an apparatus of performing containerless processing of materials on earth and in the low gravity environment of space. This disclosure describes apparatus to maintain the position of material objects in a gas without support or suspension by electromagnetic means. Levitation forces are achieved by gas flowing through a convergent-divergent portion of a conduit having circular or rectangular cross-section. Objects placed in the downstream (divergent) volume of the conduit constriction are positioned centrally in the conduit and at a particular levitation point or node on the longitudinal axis of the conduit.

Material processing is accomplished when materials are altered to produce a desired, controlled change in its composition, properties, size or shape. Basic material processing events include heating-melting, mixing-separation and cooling as a continuing fluid or to form a solid. Containerless processing requires that between injection, and the storage of the processed materials, no solid or liquid will touch the material. The system described herein has successfully processed small (up to 5 mm dia.) spheres of glasses and metals on earth at temperatures up to 1200° C.

The apparatus can position material specimens of useful size and can be adapted to a method to inject or add raw material, translate if necessary and then eject, capture and store the containerless processed material. In the processing of alloys, the method and apparatus include insertion means for adding a raw material to the region of the nodal point for combination with the specimen.

Referring now to the drawings, apparatus for levitating a specimen of material in a containerless environment is illustrated as including elongated tubular means A having a hollow interior defined by interior contoured wall means and having inlet and outlet ends. A narrow throat is formed in the hollow interior and convergent means within the hollow interior is defined by the interior wall means converging to the narrow throat. Divergent means within the hollow interior is defined by the interior wall means diverging away from the narrow throat toward the outlet end. The divergent means creates a levitation node at a point along a longitudinal axis of the divergent means at which the specimen is levitated. The inlet end of the tubular means is adapted for connection to a source of pressurized gas so that a flow is established through the divergent means suspending the specimen generally out of contact with the interior wall means whereby the specimen may be processed in a containerless environment.

Referring now in more detail to FIG. 1, elongated tubular means A is illustrated in the form of gas levitation tube 10 which is circular in cross-section having convergent-divergent means in the form of a convergent section 12 and a divergent section 14 defined before and after a minimum throat constriction diameter 15. The levitation node is in the area of the divergent section 14 along its longitudinal axis such as illustrated at 16 wherein a spherical specimen 18 is levitated by a gas flow entering inlet end 20 of the tube and exiting outlet end **20*a* which may be in the form of an expansion device. Inlet 20 may be adapted by means of flexible hosing 20*b*** for connection to a source of gas.

Any suitable divergent-convergent nozzle design may be utilized in accordance with the present invention such as one designed in accordance with conventional nozzle theory.

The interior tube shape between the convergent and divergent areas is shaped to provide non-turbulent flow through the upstream, constricted and downstream volumes. The interior tube surface must be smooth enough to prevent vortices which would cause flow separation from the tube wall. The constriction shape should prevent flow separation in the upstream (convergent) and downstream (divergent) volumes. Experience has shown that satisfactory levitation is achieved with an interior having identical, as possible, up and downstream shapes, unlike some venturi tubes. The interior volume 22 is filled with a gas such as air or hydrogen. The gas flow rate and pressure are regulated to provide the aerodynamic forces that position the materials 18 which as placed in the divergent volume.

FIG. 1 shows a cylindrical shaped material 24 levitated in circular cross-section gas levitator A.

Figure 2:
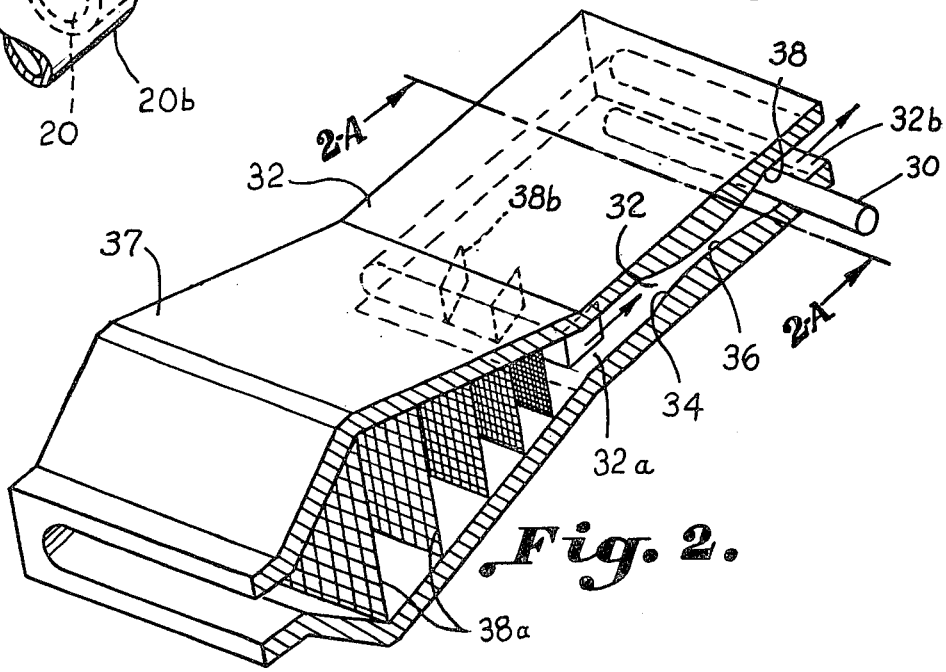
FIG. 2 is a perspective view with parts cut away illustrating a gas levitator device constructed according to the presenting having a rectangular cross-section interior.

FIG. 2 is a longitudinal cross-section of an arrangement for levitating an elongated cylindrical rod 30 in a levitator tube 32 having inlet and outlet ends **32*a* and 32*b* and an interior duct 32*c* of rectangular cross-section as seen in FIG. 2A. Longitudinally, the interior duct 30*a* resembles that of the cylindrical tube of FIG. 1 as including a convergent portion 34 throat constriction 36, and divergent portion 38 in which rod 30 is levitated at a levitation node by gas flowing therein. The design of interior duct 32*c* may be done with the same criteria as discussed above for tube 10. Inlet 32*a* may include an inlet plenum 37 which may include anti-vortex screens 38*a* carried within a stilling chamber for stabilizing the incoming gas flow. Gas deflectors 38*b*** may be utilized to direct gas to enhance levitational forces.

Figure 3:
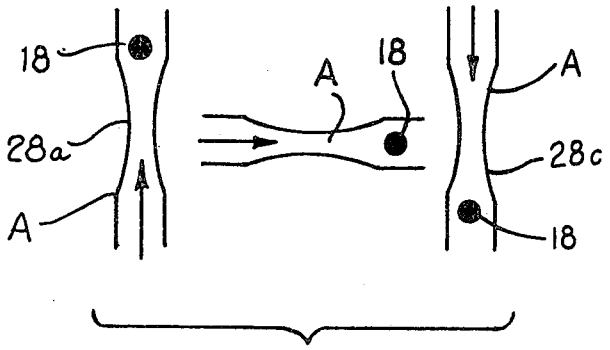
FIG. 3 is a schematic illustration showing the levitator device levitating a specimen and maintaining the specimen stable in three different attitudes.

FIG. 3 illustrates, schematically, orientation of the levitator apparatus in three different attitudes at earth gravity. A vertical attitude is shown at **28*a*, a horizontal attitude at 28*b*, and an inverted vertical attitude at 28*c*. The specimen 18** remains stable in all three attitudes as being levitated at the nodal point, thus operating of the device independent of the force of gravity.

Figure 4:
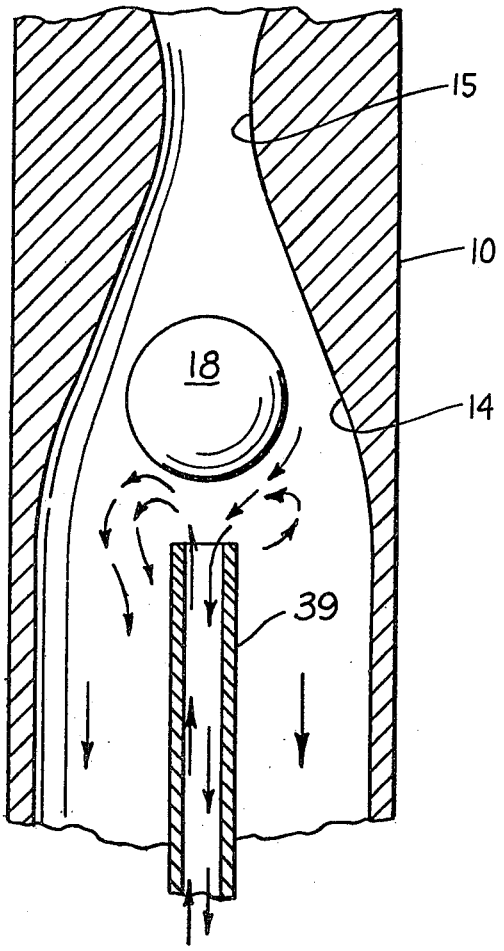
FIG. 4 is a sectional view illustrating gas levitator apparatus according to the invention with means to control the air flow and introduce materials in a region of the levitated specimen.

Referring now to FIG. 4, an enlarged view of the gas levitator tube is illustrated wherein a specimen 18 is levitated with the tube A shown in a vertical orientation and which includes air flow control means for controlling the air flow around a specimen 18 to prevent flow separation and provide stability. The means is illustrated as including a tube 39 through which a suction may be applied to control the air flow in the area behind the specimen 18. Alternately, a pressurized flow of gas, such as hydrogen, may be introduced in the tube 39 that will cool the specimen and/or provide material insertion means by which to distribute material in the area of the specimen when it is desirable in the processing of certain alloys. For example, tube 39 may be used to transfer powders, or granulated material into proximity to specimen 18 where processing of alloys or mixtures can be accomplished or multilayers of immiscible materials could be formed on an initially levitated fluid sphere.

Figure 5:
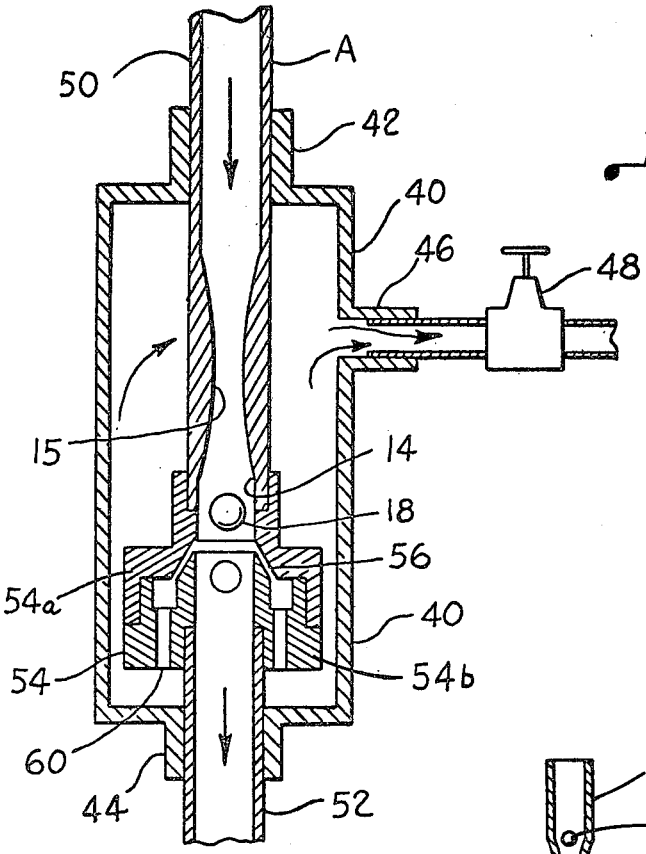
FIG. 5 is a perspective view partially cut away illustrating gas levitator apparatus constructed according to the invention which utilizes suction to establish flow in the levitator tube.

FIG. 5 illustrates apparatus utilizing suction to avoid or delay separation. The gas levitconcentric housing tube 40 which is positioned to enclose the convergent-divergent section and a gas levitator support tube 14. Housing tube 40 includes an inlet end 42 and an outlet end 44 which are closed around tube A to provide a pressure tight sliding seal. A suction port 46 is carried by the housing to provide a connection to a continuous variable, controllable pressure source (not shown) less than the gas pressure in tube A and includes a valve 48 by which the connection may be cut off and on. Tube A is cut through at a point downstream of the location of levitated material 18 and separated into sections 50 and 52. The alignment of the separated sections is maintained by a separation control gas nozzle 54 as best seen in FIG. 5 which includes an annular passage 56 inclined about 30° to the axis of the tube so that entering or leaving gas is deflected along or removed from the volume adjacent to tube interior wall. Tube section 50 is sealingly fitted within a top portion of valve 54 and section 52 within a bottom portion of valve 54 as illustrated. Alignment of tube A with the nozzle is accomplished by making the mating surfaces 54*a* and 54*b* concentric with the counterbore which locates them on tube A. Gas flows through the inclined nozzle passage through a series of holes 60 concentric with tube A in part 54*b*. In this manner, control of the flow behind specimen 18 is controlled to prevent separation of the flow from the tube interior walls and thus provide stable levitation.

The location of control nozzle 54 may be determined by a series of tests conducted on the gas levitator tube sized for the particular intended application and bench tested to give acceptable stable positioning during the processing sequence. Tube A is cut at a point downstream from the location of material 18. After assessing the position stability with varying suction, a small additional amount of upstream tube A is removed and nozzle 54 reinstalled for another test-evaluation of material stability. Throttling valve 48 is placed in the exterior suction line to adjust/maintain suction during testing and processing.

Figure 6:
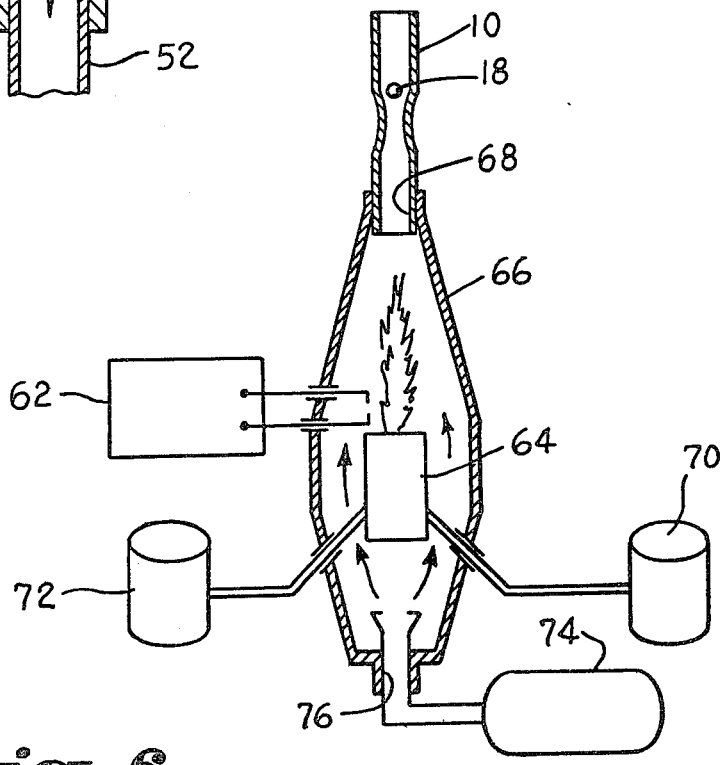
FIG. 6 is a schematic view illustrating apparatus for simultaneously heating and levitating a specimen in a gas levitator tube according to the invention.

FIG. 6 discloses apparatus for heating a material levitated in the gas levitator which may include a conventional spark igniter 62 and burner 64 carried within a housing 66. Levitator tube 10 is carried within port opening 68 in a sealed manner. Oxygen is supplied from a source 70 which is fed to burner 64 for combustion with the hydrogen supplied from source 72. A supply of inert gas 74 is illustrated which flows into housing 66 via inlet port 76 and around the burner 64 and enters the levitator tube 10. Both the inert gas and the hydrogen-oxygen gas mixture being combusted in burner 64 mix and levitate the article. The inert gas provides bulk to the levitation gas mixture. After the specimen has reached a desired temperature, the burner 64 may be cut off and the inert gas continues to levitate and cool the specimen. Nitrogen may be utilized in most cases. When processing glass specimens, an inert gas such as oxygen is preferable.

While a preferred embodiment of the invention has been described using specific terms, such description is for illustrative purposes only, and it is to be understood that changes and variations may be made without departing from the spirit or scope of the following claims.

What is claimed is:

1. Apparatus for levitating a spherical specimen at a node in a containerless environment, comprising an elongated tubular structure having an entrance duct leading into a nozzle portion and an exit duct leading from said nozzle portion;

said entrance duct and said exit duct being circular in cross-section and having generally a uniform diameter;

said nozzle portion having an upstream part that converges from the internal wall of said entrance duct to a narrow throat and a downstream part which diverges from said narrow throat to the internal wall of said exit duct, said upstream part and said downstream part of the nozzle portion being substantially identical in shape;

means for providing a gas flow into said entrance duct for levitating a specimen at a node along the longitudinal axis of said downstream duct of the nozzle portion;

a gas flow control means downstream of said nozzle portion gas flow and adjacent the node at which a specimen is levitated;

said gas flow control means including said exit duct having passages inclined and pointing upstream toward said nozzle portion; and a controllable gas pressure source communicating with said passages so that entering or leaving gas from said passages is deflected along or removed from the volume adjacent the internal wall of the exit duct.

2. Apparatus for levitating a specimen at a node in a containerless environment, comprising:

an elongated tubular structure having an entrance duct leading into a nozzle portion and an exit duct leading from said nozzle portion;

said nozzle portion having an upstream part that converges from the internal wall of said entrance duct to a narrow throat and a downstream part which diverges from said narrow throat to the internal wall of said exit duct, said upstream duct part and said downstream duct part of the nozzle portion being substantially identical in shape;

means for providing a gas flow into said entrance duct for levitating a specimen at a node along the longitudinal axis of said downstream duct of said tubular structure;

a housing about said entrance duct of said tubular structure; and heat source means within and supported by said housing for delivering heated air to said gas flow.

3. An apparatus of claim 2 including means for supplying inert gas to said housing for adding bulk to said gas flow.

* * * * *